US007799372B2

(12) United States Patent
Caspar

(10) Patent No.: US 7,799,372 B2
(45) Date of Patent: Sep. 21, 2010

(54) METHOD AND DEVICE FOR APPLYING GLUE TO A HONEYCOMB STRUCTURE

(75) Inventor: Hans-Peter Caspar, Troisdorf (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 1567 days.

(21) Appl. No.: 11/010,931

(22) Filed: Dec. 13, 2004

(65) Prior Publication Data

US 2005/0092779 A1 May 5, 2005

Related U.S. Application Data

(63) Continuation of application No. PCT/EP03/05956, filed on Jun. 6, 2003.

(30) Foreign Application Priority Data

Jun. 13, 2002 (DE) ..... 102 26 281

(51) Int. Cl.
*B05D 5/10* (2006.01)
*B05C 1/00* (2006.01)
*B05C 11/00* (2006.01)

(52) U.S. Cl. ..... 427/207.1; 118/50; 118/200; 118/211; 118/264; 118/266

(58) Field of Classification Search ..... 427/207.1; 118/50, 200, 211, 264, 266
See application file for complete search history.

(56) References Cited

U.S. PATENT DOCUMENTS

RE35,063 E 10/1995 Sadano et al.
6,425,517 B1 7/2002 Wieres et al.
6,497,039 B1 12/2002 Wieres et al.
6,634,542 B1 10/2003 Wieres
6,811,071 B2 11/2004 Caspar et al.

FOREIGN PATENT DOCUMENTS

DE 198 23 000 A1 11/1999
DE 101 51 487 C1 10/2002
GB 1 504 022 3/1978
JP 5057198 A 3/1993
JP 5309278 A 11/1993
JP 7051580 A 2/1995
JP 8131847 A 5/1996
JP 11301628 A 11/1999

OTHER PUBLICATIONS

Japanese Office Action dated Apr. 7, 2009.

*Primary Examiner*—Timothy H Meeks
*Assistant Examiner*—Cachet I Sellman
(74) *Attorney, Agent, or Firm*—Laurence A. Greenberg; Werner H. Stemer; Ralph E. Locher

(57) ABSTRACT

A plunger is used for applying an adhesive to a honeycomb structure. The plunger includes a receptacle, a plunger covering, a metering unit and a chamber. The chamber being delimited by the receptacle and the metering unit and the plunger covering is located on a side of the metering unit facing away from the chamber. The plunger is used in conjunction with a device for applying an adhesive to a honeycomb structure, in particular a metal catalyst support for purifying the exhaust gas of mobile internal combustion engines.

14 Claims, 2 Drawing Sheets

METHOD AND DEVICE FOR APPLYING GLUE TO A HONEYCOMB STRUCTURE

CROSS-REFERENCE TO RELATED APPLICATION

This is a continuation, under 35 U.S.C. §120, of copending international application No. PCT/EP03/05956, filed Jun. 6, 2003, which designated the United States; this application also claims the priority, under 35 U.S.C. §119, of German patent application No. 102 26 281.0, filed Jun. 13, 2002; the prior applications are herewith incorporated by reference in their entirety.

BACKGROUND OF THE INVENTION

Field of the Invention

The present invention relates to a plunger for gluing a honeycomb structure and to a device containing at least one such plunger. Furthermore, a method for wetting a honeycomb structure with glue is described.

The above-mentioned honeycomb structures are generally metallic structures that contain separate walls that form cells through which a fluid can flow. The walls are wetted here at least partially in the interior of the cells with an adhesive. The honeycomb structure is then placed in contact with a brazing material that adheres to the adhesive, thermal treatment then being carried out in order to form brazing connections between the separate walls. Such metallic structures or honeycomb elements are preferably used as catalytic-converter carrier elements in exhaust systems of mobile internal combustion engines.

In order to use a catalytic conversion of pollutants in the exhaust gas in such a way, and to make this conversion highly efficient, it is necessary to make available the largest possible catalytically active contact area of the metallic structure. For this reason, in the last few years a development trend in the direction of high cell densities and very thin cell walls has become apparent. The use of very thin cell walls, in particular made of high-temperature-proof and corrosion-proof metal foils result in the connections of the cell walls to one another having to be made in a way which takes into account the high thermal and dynamic stress in the exhaust system of an automobile. Thus, in order, for example, to ensure a thermally conditioned compensation expansion between walls of the cells and the housing which surrounds the honeycomb structure, it is necessary to connect the cell walls to one another at least partially only in a predefinable axial section so that a complete, comprehensive connection over the entire length of the cells is avoided. The limits of the connecting section are also to be complied with as precisely as possible here in terms of fabrication.

A further increase in the catalytically active surface is achieved in that the relatively smooth cell walls or metal foils are coated with what is referred to as a wash coat, which has a highly fissured surface. The fissured surface ensures, on the one hand, that a sufficiently large amount of space is made available for securing catalytically active components (for example platinum, rhodium, etc. are used as catalytic converters) and serves, on the other hand, for eddying the exhaust gas which flows through, a particularly intensive contact with the catalytic converter being brought about. However, the application of the wash coat has resulted in a further reduction in the cross section of the honeycomb element through which there is a flow, which can lead to an undesired drop in pressure over the catalytic-converter carrier element, in particular when the cell densities are high. In this regard, it is significant to dispose the brazing material in each case only at the contact points between the cell walls in order to avoid unnecessarily increasing the cover height (brazing material+wash coat) on top of the cell wall further.

In order to ensure that the cell walls are permanently connected to one another, or that the metal foils are permanently connected to one another and, if appropriate, to a housing which surrounds the honeycomb element, it is of particular interest to produce precisely defined connecting regions. In this regard it is desirable, in respect of connection of metal foils by a brazing method, that the brazing material actually accumulates only in these desired connecting regions and also does not run out of these regions during the subsequent thermal treatment of the honeycomb element. In this context, a number of techniques for disposing an adhesive or a glue in the interior of such a honeycomb element in order to secure the brazing material which is supplied later are already known.

Such a method for manufacturing a catalytic-converter carrier element is disclosed, for example, in U.S. Pat. No. 5,082,167 and Reissued U.S. Pat. No. 35,063. In particular, the technical problems relating to the metering and the application of the brazing material to the honeycomb structure are described. For example it is explained that excessive consumption of the brazing material together with inaccurate application of glue can lead to corrosion in the metal foils, in which case it is to be noted that the glue or the binding agent is disposed only at the points of contact or contact regions of the metal foils. Furthermore, it is explained in the document that applying the brazing material before a wrapping or cover process of the metal foils is problematic since, on the one hand, the final diameter of the honeycomb element cannot be set precisely owing to the brazing material grains which are disposed between the metal foils, and under certain circumstances gaps may be brought about owing to the subsequent liquefaction of the grains between the adjacently disposed metal foils. Spraying the catalytic-converter carrier element with glue over its end side into internal regions has also proven ineffective since it is very difficult to access the corresponding connecting regions in the interior of the cells with a nozzle.

Reissued U.S. Pat. No. 35,063 proposes manufacturing a catalytic-converter carrier element that has a honeycomb structure by forming layers of smooth and corrugated metal foils and wrapping them. The honeycomb structure is subsequently placed in contact with a suction sponge. The suction sponge is disposed in the upper part of a container with a binding agent or an adhesive and steeped in it. When the honeycomb structure is placed on the suction sponge, the binding agent is forced out of the interior of the suction sponge and into the interior of the ducts of the honeycomb structure owing to a capillary effect. After the adhesive has risen to the desired height in the interior of the cells, the end side of the honeycomb structure is removed from the suction sponge. This process can, if appropriate, be repeated from the other end side of the honeycomb structure.

In terms of the suction sponge it is explained that it is ensured that sufficient adhesive is continuously made available since the suction sponge can always suck up adhesive from one side from an adhesive reservoir and discharge it again over another surface. However, the suction sponge has a plurality of pores and passages which each have greatly varying flow cross sections. This can lead to a situation in which it is not possible to ensure that adhesive is uniformly made available on the surface onto which the metallic structure or the honeycomb element is fitted. In addition, it is possible for impurities that are produced within the scope of the fabrication of such honeycomb elements and are deposited on the suction sponge or in the adhesive reservoir, to result in increasing worsening of the quality of the metering. This would result, for example, in frequent interruption in the fabrication since the suction sponge often has to be cleaned or replaced. If this does not take place, catalytic-converter carrier elements with a very different quality in terms of their connections and thus also durability are produced, which cannot be tolerated in particular in automobile engineering or in exhaust gas equipment. Furthermore, the suction sponge sucks glue out of the adhesive reservoir as long as there is a connection to a honeycomb element so that metering is possible only by controlling in a very precisely timed way.

A further method for manufacturing a metallic structure or a device for wetting the metallic structure with an adhesive is disclosed by commonly assigned, German Patent Application DE 101 51 487, corresponding to U.S. Pat. No. 6,811,071. The method described in the document is distinguished by the fact that the adhesive or glue is fed in a metered fashion by at least one metering element that is connected to the adhesive or glue and is configured in a honeycomb shape. The adhesive passes into the metering element via the inlet side and is passed on uniformly into the cells of the honeycomb structure via the outlet side.

The metering element may also be provided here with a cover through which the glue can penetrate and which extends over the outlet side of the metering element. The cover has here, inter alia, the function of distributing over the cross section the adhesive which emerges from the feed lines of the metering element. In order to ensure such distribution of the adhesive, use has previously been made of, for example, a stripper that is fitted onto the cover and rolled over it under pressure. The moisture of the cover or the quantity of adhesive contained in the cover is then set, for example, by different application forces of the roller stripper.

SUMMARY OF THE INVENTION

It is accordingly an object of the invention to provide a method and a device for applying glue a honeycomb structure which overcome the above-mentioned disadvantages of the prior art devices and methods of this general type, in which it is possible to provide the honeycomb structure with glue in a way which is reliable in terms of processing even within the scope of a series fabrication method. In this context, the emphasis is on filling or wetting the gluing plunger cover precisely and uniformly avoiding a stripping process that can be reproduced only to a certain degree. Furthermore, the intention is to make it possible to adjust the specific moisture of the cover or the degree of filling of the cover with glue. Furthermore the intention is to ensure that the plunger cover is easily attached and can, if appropriate, be quickly replaced for maintenance purposes.

The plunger according to the invention for applying glue to a honeycomb structure contains a receptacle, a plunger cover, a metering or dosing unit and a chamber. The chamber is bounded by the receptacle and the metering unit. The plunger cover is disposed here on a side of the metering unit that faces away from the chamber. In this context, direct contact between the suction sponge or the metering element and the glue is prevented. The metering unit is covered here on one side by the plunger cover and on the other side by the receptacle or the chamber. The metering unit is preferably embodied in the same way as the metering element, which is described in U.S. Pat. No. 6,811,071 which is herewith incorporated by reference in its entirety.

In order to explain the functions of the individual components of the plunger according to the invention, reference will now be made to a possible use of the plunger. The filling or wetting of the plunger cover with glue is thus carried out, for example, by dipping the plunger in a glue reservoir, the glue also penetrating the metering unit via the plunger cover. The plunger cover is composed, for example, of a technical filtered woolen board and/or velvet or velour, which is preferably embodied as a type of disk with a predefined diameter. The external shape (round, cornered . . . ) of the glue cover is to be configured taking into account the contact region of the plunger with the honeycomb structure. After the wetting of the plunger cover, the desired quantity of glue is set, which is explained in more detail in the description below. The chamber which is disposed on the side of the metering unit facing away from the plunger cover is used here as a container for excess glue. As a result of the fact that the desired quantity of glue is set precisely and the excess glue is carried away into the chamber, a stripping process, for example by a roller stripper, is no longer necessary, but uniform wetting or moistening of the plunger cover over the entire cross section is ensured.

According to one development of the plunger, the metering unit is a structure that is at least partially porous and/or constructed in the manner of a honeycomb, in particular in a disk shape. The metering unit is used primarily as a glue store, the glue which is stored in it being capable of being fed to the plunger cover as a result of capillary effects when the cover discharges its quantity of glue on contact with the honeycomb structure to be glued. The term porous structure is intended here to mean that it has pores, openings, cavities and/or the like at least in certain sections, with these not necessarily each having an opening on both sides of the metering unit. The porous structure is preferably composed of a sintered metal, plastic foam or ceramic foam or similar materials. A structure which is constructed in the manner of a honeycomb is distinguished from the above by feed lines which are separated from one another and which each have an inlet opening on one side of the metering unit and an outlet opening on the other side of the metering unit. The feed lines are disposed in an essentially linear fashion and parallel to one another. For further parameters of such a metering unit, reference is made again at this point to U.S. Pat. No. 6,811,071. The honeycomb like structure is composed, for example, of smooth and/or corrugated metal foils, perforated disks or the like.

According to a further embodiment of the plunger, it has a device for generating a predefinable pressure in the chamber. The device preferably contains a regulating unit for setting a predefinable pressure in the chamber. In this way, a desired difference in pressure is set between the interior of the chamber and the surroundings of the plunger. By setting a partial vacuum in the chamber it is possible, for example, to suck out the excess quantity of glue from the metering unit or the plunger cover. With respect to the application of a partial vacuum in the chamber, it is ensured that a suction effect that is uniform over the cross section of the metering unit or the plunger cover is generated, as a result of which the plunger cover or the metering unit is filled uniformly and homogenously. In addition, the process can be carried out very quickly and without using a large amount of energy, which is advantageous in particular with respect to the series fabrication of catalytic-converter carrier elements configured in the form of a honeycomb for the automobile industry. However, by bringing about an excess pressure in the chamber it is also possible to facilitate changing of the plunger cover.

Furthermore it is proposed that the plunger have at least one sensor for determining the quantity of glue which is taken up by the plunger, with the at least one sensor being preferably integrated into the plunger cover and/or into the metering unit itself. The measurement of the amount of glue that is taken up by the plunger (plunger cover and/or metering unit) can be carried out according to an electrical principle (resistance, current flow, electrical conductance etc.) or a physical principle (difference in pressure, pressure drop time etc.). A person skilled in the art can use a variety of known sensors to sense these measured values. The at least one sensor is preferably disposed here in such a way that it is in contact with the glue. In this way, the moistness of the plunger cover or the quantity of glue in the metering unit is a measurable process parameter. As a result, it is possible, for example, also to determine the aging of the plunger cover by compressing or soiling in this way by sensing different through-flow rates, pressure ratios and the like. The sensing of the quantity of glue which is taken up by the plunger permits a catalytic-converter carrier element to be glued with an essentially constant quantity of glue over a plurality of gluing processes even if the quality of the plunger cover changes or the gluing process is carried out by different persons.

According to a further embodiment of the plunger, the plunger cover is embodied with a varying permeability, the permeability being preferably increased in radially outer regions of the plunger in comparison with centrally disposed regions. The permeability or if appropriate also the storage capability of the plunger cover is determined essentially by the construction. For example porosity, the feed density per unit cross section, the material etc. are essential. A permeability which is implemented in different ways over the cross section of the plunger cover permits the glue process to be adapted to the product requirements of the honeycomb structure since the permeability has a considerable influence on the capillary effects.

Therefore, for example, an increased application of glue can be brought about in the radially outer regions. If the honeycomb structure which is to be manufactured is a catalytic-converter carrier element which contains a plurality of sheet-metal foils which are to be soldered to one another and a housing which is disposed around it, it is under certain circumstances desirable to dispose an increased quantity of glue particularly in a radially outer region of the catalytic-converter carrier element in which the metal foils meet the housing. Since the metal foils which form the honeycomb structure generally react in a relatively sensitive way to overloading with the brazing material, it is possible to apply a smaller quantity of glue in the central region by use of the plunger according to the invention. However, it is also possible to divide the plunger cover in a different way from this in terms of its different permeability in order to fulfill other product requirements. A further possible way of metering glue over the cross section of the plunger in a variable manner can also be implemented by a plurality of chambers to which different pressures can be applied individually.

According to a further embodiment of the plunger, the plunger cover is applied to the metering unit and is secured to the metering unit by at least one suction unit. The suction unit is preferably formed by the chamber and a regulating unit in order to set a predefinable pressure in the chamber. This serves the advantage that it is possible to dispense with additional attachment devices for securing the plunger cover on the metering unit. In particular, the plunger cover is made easy to change. For this purpose, the chamber is preferably provided with an excess pressure (at least in part or in certain sections) by the regulating unit, in which case the plunger cover can easily be released from the metering unit. As a result of the embodiment of the suction unit by use of the chamber and a regulating unit, the plunger cover can be secured, on the one hand, by applying a partial vacuum in the chamber, and attached, and on the other hand when an excess pressure is applied in the chamber the plunger cover can be quickly removed without a tool and replaced with a new plunger cover. In this context it is also possible to embody the plunger cover locally and also in a way which is impermeable to air, and to secure it particularly in this region by applying a partial vacuum. Such an embodiment of the plunger increases the ease of maintenance since the plunger cover can be quickly changed and laborious secondary activities such as, for example, the process of covering the glue plunger, can be omitted.

According to a further aspect of the invention, a device for gluing a honeycomb structure is proposed. The device contains at least one glue reservoir and at least one plunger according to the invention. The at least one plunger can be moved in relation to the glue reservoir by a drive. A plurality of different containers, nozzles, sponges, rollers and the like can be used as the glue reservoir. In this context, the drive has to dip the plunger into the glue reservoir in such a way that glue can be fed from the glue reservoir via the plunger cover or the metering unit.

If the glue reservoir is, for example, a container that is at least partially filled with liquid glue, it is particularly advantageous if the drive generates a reciprocating movement of the plunger in the direction of an axis of the plunger. In the process, the plunger dips so far into the glue reservoir or glue in one direction of the reciprocating movement that the plunger cover is in direct contact with the glue. The drive subsequently moves the plunger in the opposite direction again and out of the glue so that direct contact between the glue located in the glue reservoir and the plunger cover is no longer provided. Such a reciprocating system is relatively economical and unsusceptible to faults so that here to it is possible to use the system for series fabrication of honeycomb structures.

According to a further embodiment of the invention, at least one positioning unit is provided which ensures a substantially central configuration of an end side of a honeycomb element with respect to the axis of the plunger. Therefore, the at least one positioning unit ensures a substantially central or aligned arrangement of the honeycomb structure with respect to the plunger or plunger cover. When there is subsequently contact between the end side of the honeycomb element and the plunger cover, the desired quantity of glue is transferred to the honeycomb structure, uniform application occurring in particular by pressure that is distributed evenly over the cross section of the plunger cover.

According to yet another aspect of the invention, a method for wetting a honeycomb structure with glue is proposed. In the method, a plunger is at least partially dipped into a glue reservoir that is at least partially filled with glue. The glue is taken up by way of the plunger cover and into a metering unit of the plunger. The plunger is removed from the glue reservoir so that at least the plunger cover is exposed. A predefinable quantity of glue is set in the plunger cover and/or the metering unit, wherein an excess quantity of glue is conducted away into a chamber on the side of the metering unit facing away from the plunger cover. The plunger cover is placed in contact with an end side of a honeycomb element.

The method described above is preferably carried out using the plunger according to the invention or the device according to the invention for wetting a honeycomb structure.

It is particularly advantageous here that the predefinable quantity of glue is set by at least partially generating a predefinable differential pressure between the surroundings outside the plunger and the chamber. In this context, in order to remove an excess quantity of glue in the plunger cover and/or the metering unit, a partial vacuum is preferably to be applied in the chamber in order to cause this excess quantity of plunger to be carried away into the chamber. In order to generate such a predefinable differential pressure it is suitable to use a plurality of known pump systems which are connected to the chamber, for example piston pumps, displacer pumps, gear wheel pumps, impeller wheel pumps, wobble plate and swash plate pumps, blocking vane and roller vane pumps or the like.

According to a further refinement of the method, in order to set the predefined quantity of glue, the quantity of glue that is actually taken up by the plunger is first determined by at least one sensor. Therefore the plunger is first placed in contact with the glue of the glue reservoir and the latter takes up an unspecific quantity of glue and is removed from the glue reservoir again. The quantity of glue that is taken up in the plunger cover or the metering unit is then determined by the sensor (as has already been described above). Alternatively or else in combination with this it is possible for the quantity of glue which is actually taken up by the plunger also to be already determined while the plunger dips into the glue reservoir (for example by way of through flow measurement). The sensed measured values are used, for example in a computer unit, for determining the quantity of glue taken up, the regulating unit setting the differential pressure or the time period for which such a differential pressure is applied, as a function of the sensed measured values.

It is also proposed that the excess quantity of glue be collected in the chamber and removed at predefinable intervals. The excess quantity of glue can be removed from the chamber here at fixed time intervals, as a function of the wetting processes which are carried out and/or as a function of the degree to which the chamber is filled. For this purpose, it is possible to provide, for example, the receptacle of such a plunger with a discharge that has a sealing device that permits the collected glue to be discharged as a function of the predefined intervals.

According to a further refinement of the method, the plunger carries out a reciprocating movement in the direction of an axis of the plunger in order to dip into and emerge from the glue in the glue reservoir. The simple movement of the plunger permits clocking times to be reduced and cost-effective drives to be used when manufacturing catalytic-converter carrier elements.

Other features which are considered as characteristic for the invention are set forth in the appended claims.

Although the invention is illustrated and described herein as embodied in a method and a device for applying glue to a honeycomb structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
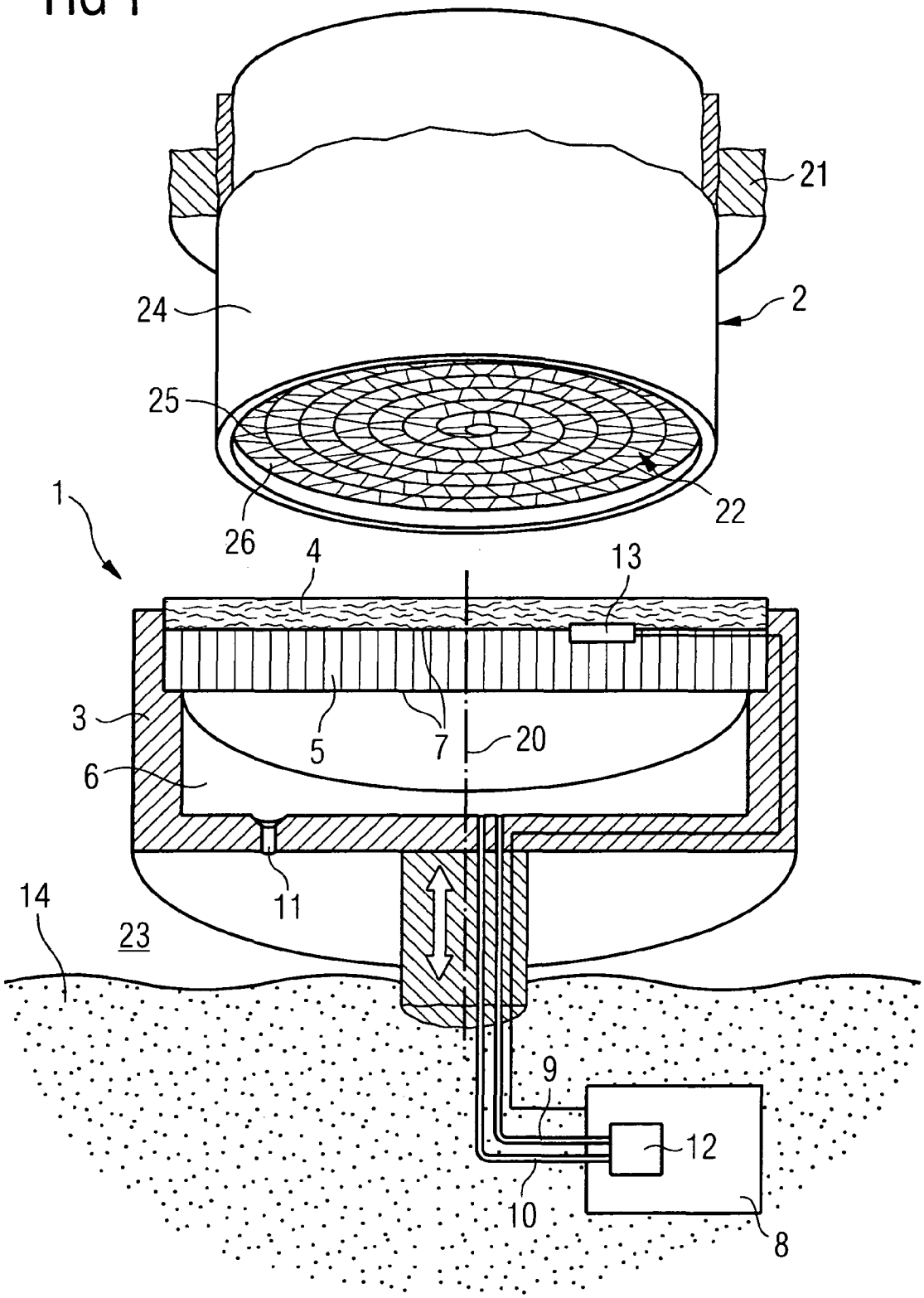
FIG. 1 is a diagrammatic, perspective view of a honeycomb structure and a sectional view of a plunger according to the invention.

Referring now to the figures of the drawing in detail and first, particularly, to FIG. 1 thereof, there is shown a plunger 1 for applying glue to a honeycomb structure 2. The plunger 1 contains a receptacle 3, a plunger cover 4, a metering unit 5 and a chamber 6. The chamber 6 is bounded by the receptacle 3 and the metering unit 5. The plunger cover 4 is disposed here on a side 7 of the metering unit 5 facing away from the chamber 6. In the illustrated embodiment, the metering unit 5 is of honeycomb-like construction. In order to set different pressures in the interior of the chamber 6, the chamber 6 is connected to a regulating unit 8 via a feed line 9 and a discharge line 10 as well as a pump 12. The regulating unit 8 controls a pump 12, as a function of the measurement results from which the quantity of glue which is actually taken up by the plunger 1 can be determined, and the regulating unit 8 thus also determines a pressure difference between an interior of the chamber 6 and surroundings 23 of the plunger 1. In order to wet the plunger cover 4 or the metering unit 5 with glue 14, the plunger 1 can be moved up and down parallel to an axis 20. By applying a partial vacuum in the chamber 6 after it emerges from a glue reservoir, the excess quantity of glue is fed into the chamber 6, and the chamber 6 can be emptied at predefinable intervals via a discharge 11.

A honeycomb structure 2 is illustrated schematically centrally with respect to the plunger 1 and the honeycomb structure 2 can be placed in contact with the plunger 1 by a positioning unit 21. The honeycomb structure 2 contains here a housing 24 which contains a plurality of at least partially structured metallic foils 25 which are disposed in such a way that cells 26 through which a fluid (in particular exhaust gas) can flow are formed. The metallic foils have a thickness that is usually less than 50 μm, in particular even less than 20 μm. The density of cells of a honeycomb structure 2 which is suitable for use in exhaust systems of automobile internal combustion engines is in the range between 600 and 1600 cpsi (cells per square inch).

An end side 22 of the honeycomb structure 2 is placed in contact with the plunger cover 4, the glue that is stored in the plunger cover 4 or in the metering unit 5 being disposed in the common contact points between the foils 25 of the honeycomb structure 2 as a result of capillary effects. When the honeycomb structure 2 is later brazed, the glue serves as an adhesive for securing brazing powder in these regions. With respect to the contact between the honeycomb structure 2 and the plunger 1 it is also to be noted that the contact preferably lasts until virtually the entire glue content of the plunger cover 4 or of the metering unit 5 has been applied to the honeycomb element 2. However, under certain circumstances it may also be necessary to limit the contact in terms of time to such an extent that a residual quantity of glue remains in the plunger 1.

The plunger 1 has at least one sensor 13 for determining the quantity of glue that is taken up by the plunger. The sensor 13 is preferably integrated into the plunger cover 4 and/or into the metering unit 5.

Figure 2A:
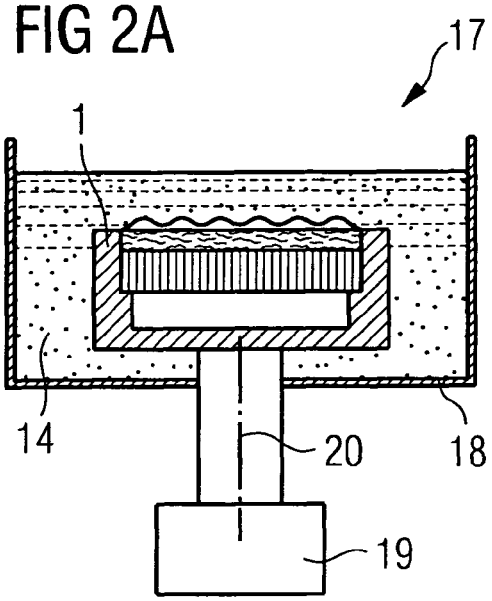
FIG. 2A is an illustration showing a device for wetting the honeycomb structure in a dipped-in state.
Figure 2B:
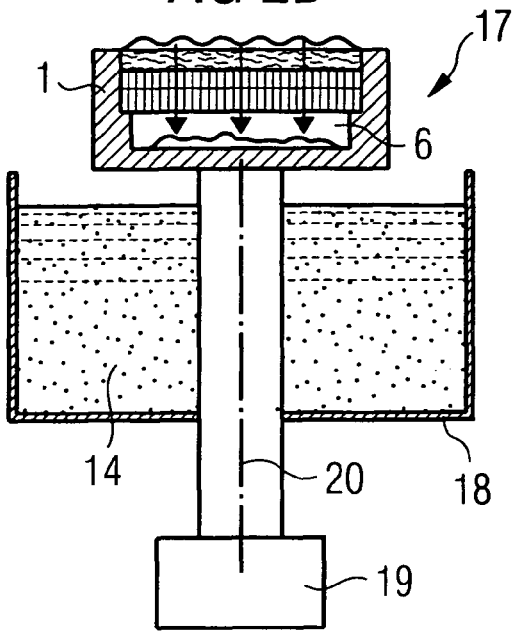
FIG. 2B is an illustration of the device from FIG. 2A in an emerged state.

FIGS. 2A and 2B are schematic views of a device 17 for wetting the honeycomb structure 2. In FIG. 2A, the plunger 1 is dipped into a glue reservoir 18 which is filled with glue 14. To do this, a drive 19 is used which facilitates a reciprocating movement of the plunger 1 parallel to the axis 20. FIG. 2B shows the device 17 in the emerged state. By briefly applying (for example 1-5 seconds) a partial vacuum which may, for example, be 5-50 mbar less than the ambient pressure, in the chamber 6, the glue 14 which is disposed on the plunger cover 4, or is excess glue, is sucked into the chamber 6, as is illustrated by the arrows. The plunger cover 4 or the metering unit 5 then stores only the desired quantity of glue, which is then subsequently to be transferred to the honeycomb structure 2.

Figure 3:
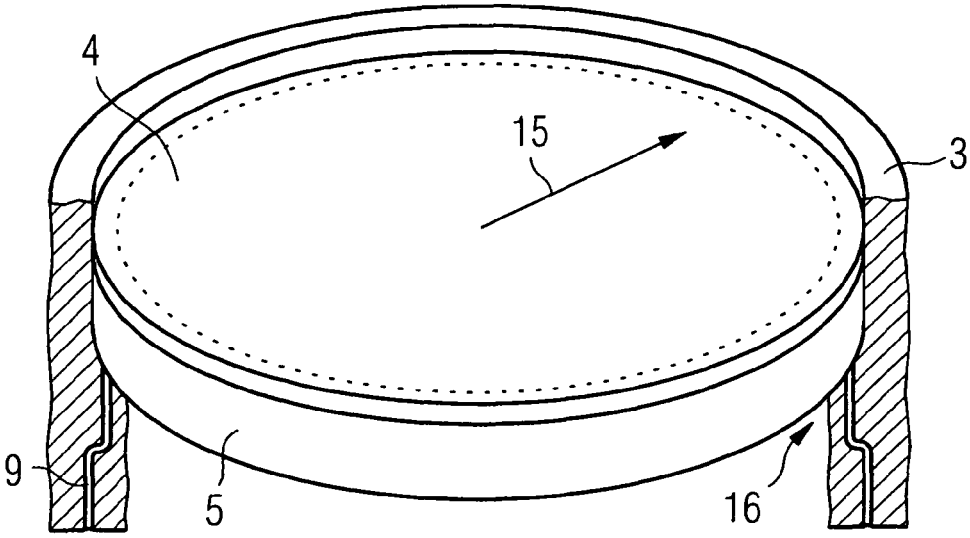
FIG. 3 is a perspective and sectional view of a detail of the plunger.

FIG. 3 is a schematic and perspective view of a detail of the plunger 1, the receptacle 3 of the plunger 1 being represented at least partially in section. The receptacle 3 is used to secure the position of the plunger cover 4 and of the metering unit 5. The plunger cover 4 is held here by a suction unit 16 that is composed of the feed lines 9 and the corresponding regulating unit 8. Accordingly, in order to secure the plunger cover 4, a suction force is applied in regions lying on the outside in the direction of a radius 15 while the plunger cover 4 is inserted. In order to change the plunger cover 4, an excess pressure is applied in the feed lines 9 so that the plunger cover 4 can easily be released from the receptacle 3. The metering unit 5 is preferably of duct-like construction in its radially outer regions. The plunger cover 4 is preferably airtight there, only the radially inner regions being used to wet the honeycomb structure with glue.

The methodology that have been previously described ensure the precise determined quantity of glue which is transferred to the honeycomb structure on contact with the plunger. This results in a method, which is reliable in terms of processing, for fabricating, for example, catalytic-converter carrier elements for performing an emission control on exhaust gases of mobile internal combustion engines.

I claim:

1. A plunger for applying glue to a honeycomb structure, the plunger comprising:

a metering unit;

a plunger cover;

a receptacle, said receptacle and said metering unit defining and bounding a chamber, said plunger cover disposed on a side of said metering unit facing away from said chamber; and a device for generating a predefinable pressure in said chamber.

2. The plunger according to claim 1, wherein said device includes a regulating unit for setting the predefinable pressure in said chamber.

3. A plunger for applying glue to a honeycomb structure, the plunger comprising:

a metering unit;

a plunger cover;

a receptacle, said receptacle and said metering unit defining and bounding a chamber, said plunger cover disposed on a side of said metering unit facing away from said chamber; and at least one sensor for determining a quantity of the glue taken up by the plunger.

4. The plunger according to claim 3, wherein said sensor is integrated into at least one of said plunger cover and said metering unit.

5. A plunger for applying glue to a honeycomb structure, the plunger comprising:

a metering unit;

a plunger cover being embodied with a variable permeability, and said permeability increasing in radially outer regions of said plunger cover in comparison with centrally disposed regions; and a receptacle, said receptacle and said metering unit defining and bounding a chamber, said plunger cover disposed on a side of said metering unit facing away from said chamber.

6. A plunger for applying glue to a honeycomb structure, the plunger comprising:

a metering unit;

a plunger cover;

a receptacle, said receptacle and said metering unit defining and bounding a chamber, said plunger cover disposed on a side of said metering unit facing away from said chamber; and a regulating unit for setting a predefinable pressure in said chamber, said chamber and said regulating unit further defining a suction unit;

said plunger cover being applied to said metering unit and being secured to said metering unit by said suction unit.

7. A device for applying glue to a honeycomb structure, the device comprising:

at least one glue reservoir;

a drive; and at least one plunger being movable in relation to said glue reservoir by said drive, said plunger containing:

a metering unit;

a plunger cover; and a receptacle, said receptacle and said metering unit defining and bounding a chamber, said plunger cover disposed on a side of said metering unit facing away from said chamber.

8. The device according to claim 7, wherein said drive generates a reciprocating movement of said plunger in a direction of an axis of said plunger.

9. The device according to claim 8, further comprising at least one positioning unit for ensuring a substantially central configuration of an end side of the honeycomb structure with respect to the axis of said plunger.

10. A method for wetting a honeycomb structure with glue, which comprises the steps of:

providing a device for applying glue according to claim 7;

dipping the plunger at least partially into the glue reservoir being at least partially filled with the glue;

taking up the glue by way of the plunger cover and/or into the metering unit of the plunger;

removing the plunger from the glue reservoir for exposing at least the plunger cover;

setting a predefinable quantity of the glue in the plunger cover and/or the metering unit;

conducting away any excess quantity of the glue into the chamber on a side of the metering unit facing away from the plunger cover; and placing the plunger cover in contact with an end side of the honeycomb structure.

11. The method according to claim 10, which further comprises setting the predefinable quantity of the glue by at least partially generating a predefinable differential pressure between surroundings outside the plunger and the chamber.

12. The method according to claim 10, which further comprises setting the predefinable quantity of the glue by using at least one sensor to determine a quantity of the glue being actually taken up by the plunger.

13. The method according to claim 10, which further comprises:

collecting an excess quantity of the glue in the chamber; and removing the excess quantity of the glue at predefined intervals.

14. The method according to claim 10, which further comprises carrying out a reciprocating movement of the plunger in a direction of an axis of the plunger to dip into and emerge from the glue in the glue reservoir.

* * * * *